United States Patent [19]

Weise

[11] 4,003,048

[45] Jan. 11, 1977

[54] REMOTE ALARM SYSTEM FOR DETECTION OF FIRE EXTINGUISHER REMOVAL

[76] Inventor: George Weise, 1462 Alps Road, Wayne, N.J. 07470

[22] Filed: Feb. 23, 1976

[21] Appl. No.: 660,539

[52] U.S. Cl. ..... 340/280; 340/256; 340/409; 339/80

[51] Int. Cl.[2] ..... G08B 21/00

[58] Field of Search ..... 340/280, 289, 272, 409, 340/256; 169/23, 51; 200/61.08, 61.59, 61.62, 61.58; 339/80

[56] References Cited

UNITED STATES PATENTS

| | | | |
|---|---|---|---|
| 3,145,375 | 8/1964 | Webb | 340/289 X |
| 3,781,861 | 12/1973 | Adler et al. | 340/280 |

*Primary Examiner*—John W. Caldwell
*Assistant Examiner*—William M. Wannisky
*Attorney, Agent, or Firm*—James J. Cannon, Jr.; James J. Cannon

[57] ABSTRACT

A detection and alarm system for detecting and removal of a fire extinguisher from its usual location including an electrically conductive breakaway lanyard positioned around the neck of the fire extinguisher, its ends connected to two male prongs plugged into a female receptacle of a supervisory circuit leading to an alarm circuit. When the supervisory circuit is interrupted by the removal of a fire extinguisher, a relay trips the alarm circuit.

6 Claims, 4 Drawing Figures

REMOTE ALARM SYSTEM FOR DETECTION OF FIRE EXTINGUISHER REMOVAL

FIELD OF THE INVENTION

This invention pertains to a detection and alarm system triggered by the removal of a portable fire extinguisher from its normal storage bracket. It includes an electrical circuit which provides supervisory current connected through a relay to an alarm circuit for detection of the removal of the fire extinguisher upon interruption of the supervisory circuit.

DESCRIPTION OF THE PRIOR ART

The unexpected removal of a portable fire extinguisher from its mounting bracket or case usually results from its use in extinguishing a fire, or from accidental removal, negligence or vandalism. Whatever the cause, it is desirous that the person responsible for fire protection know about a missing fire extinguisher as soon as possible. The failure to notice a missing fire extinguisher could produce a safety hazard. Usually extinguishers are neglected except for inspection and recharging. Furthermore, if there should be a fire, it is frequent that the fire extinguisher will be utilized before a manual alarm is sounded. The present invention will provide notice of a fire as soon as the extinguisher is taken from its usual position.

To the best of the inventor's knowledge there are no currently available systems which provide the detection and alarm capabilities of the present invention. Additionally, the present invention is inexpensive to manufacture, simple to install and reliable to use.

SUMMARY OF THE INVENTION

The present invention is directed to the detection of the removal of a portable fire extinguisher from its usual position and the giving of an alarm upon said detection. It utilizes a supervisory circuit connected to a power source. When the supervisory circuit is activated by its interruption, that is, the removal of a fire extinguisher, a relay activates the alarm circuit. The supervisory circuit includes a break-away wire lanyard circumscribing the neck of a fire extinguisher. The wire lanyard is fixably connected to a socket having two male prongs and a complimentary female receptacle.

The supervisory circuit wire lanyard connects through male prongs to the female receptacle of an electrical socket which receives the supervisory current. Should the wire lanyard be broken or should the male plugs be dislodged by removal, a relay which is sensitive to the upsurge in supervisory current will activate through an alarm circuit an appropriate alarm device. Further features and advantages will become apparent from the following drawings and descriptions thereof.

DESCRIPTION OF THE DRAWINGS

Figure 1:
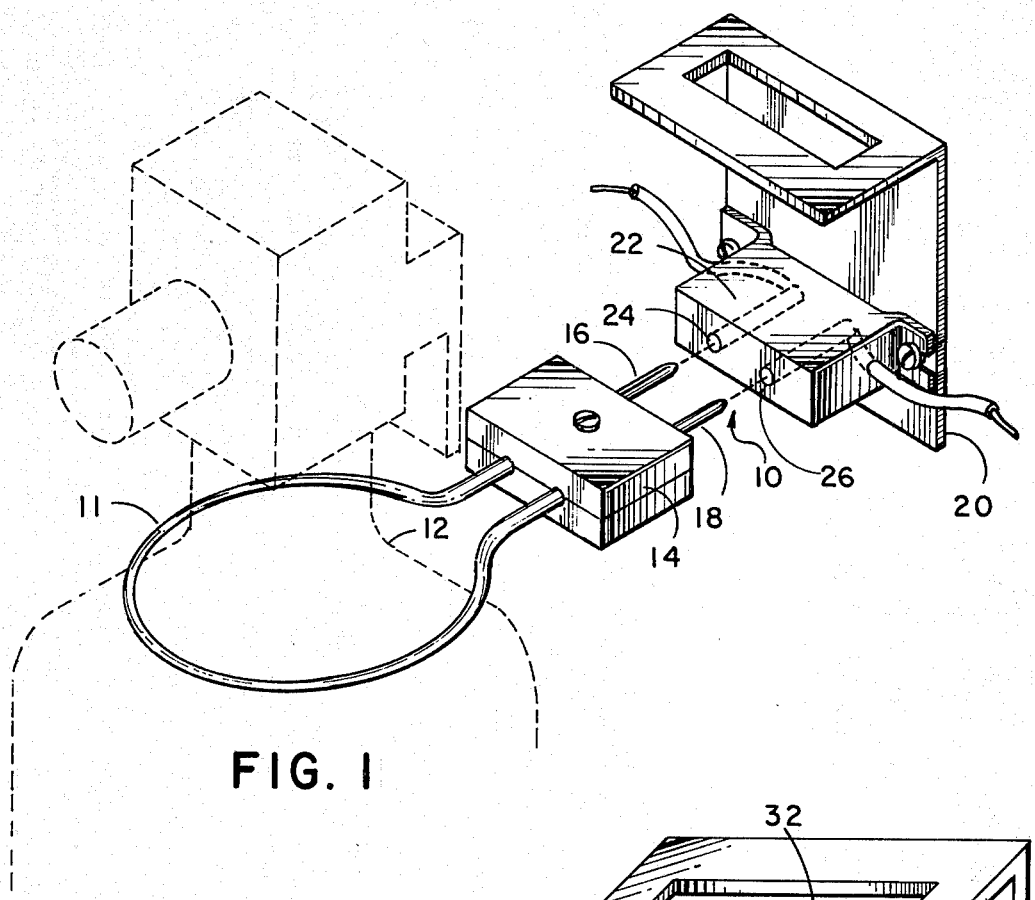
FIG. 1 illustrates a side view of the wire lanyard detection device and the related electrical connection.

Referring now to FIG. 1, detection device 10 is comprised of breakaway wire lanyard 11, which encompasses a fire extinguisher, preferably about the neck 12. Locking box 14 fixably secures the ends of wire lanyard 11. Two male prongs 16 and 18, in communication with each end of wire lanyard 11, emanate from the rear of locking box 14.

Bracket 20 may be fixably attached to a wall at the desired extinguisher location and may further have a recessed opening to position the head of the extinguisher. Attached to bracket 20 is housing jack 22 which contains two female receptacle poles 24, 26 which receive male prongs 16, 18 respectively. Wire lanyard 11 should be of a thickness and strength which would allow it to break should its socket-like male prong-female receptacle connection become stuck together.

Figure 2:
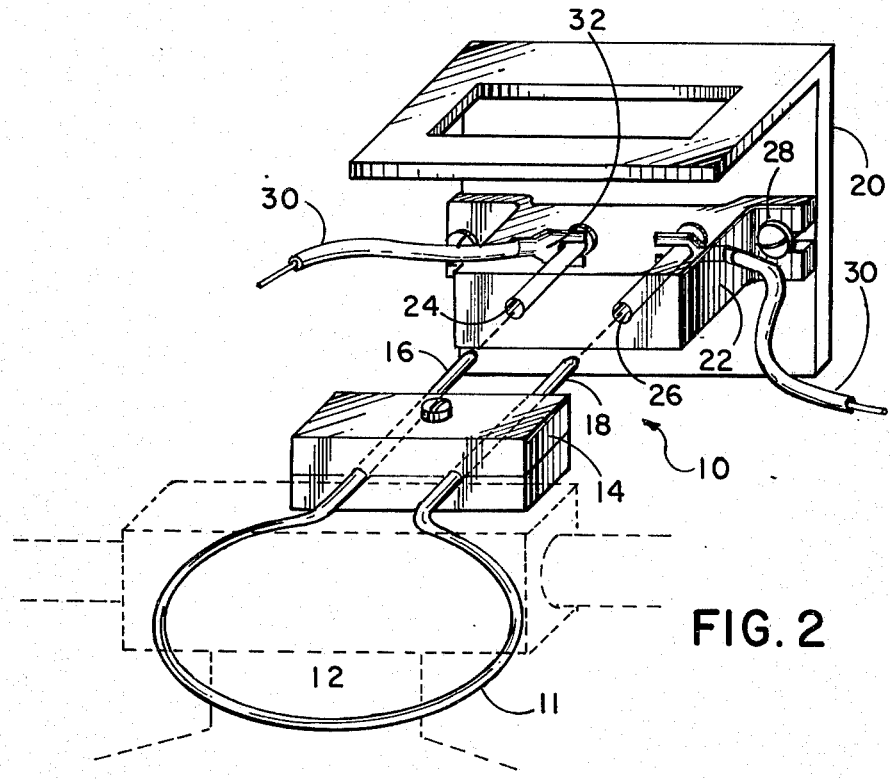
FIG. 2 is a front view of the detection device and related electrical connection of FIG. 1.

Referring to FIG. 2 it can be seen that the housing jack 22 is fixably secured at its edges to bracket 20 by screws 28. Supervisory circuit wire 30, providing current from a power source, is connected by wire screw fasteners 32 to one female receptacle pole 24, and an output circuit wire 30, to the next extinguisher detection lanyard in series, is similarly connected to female prong 26. Thus, when male prongs 16, 18 are inserted, current will be transferred through break-away wire lanyard 11 to the next extinguisher in series.

When an extinguisher is removed, the two male prongs 16, 18 act as a break-away circuit breaker and the supervisory circuit is interrupted. Also, should wire lanyard 11 be broken, the supervisory circuit will be interrupted, and the supervisory current will be transferred to an alarm circuit, which up to this point has received no current.

Figure 3:
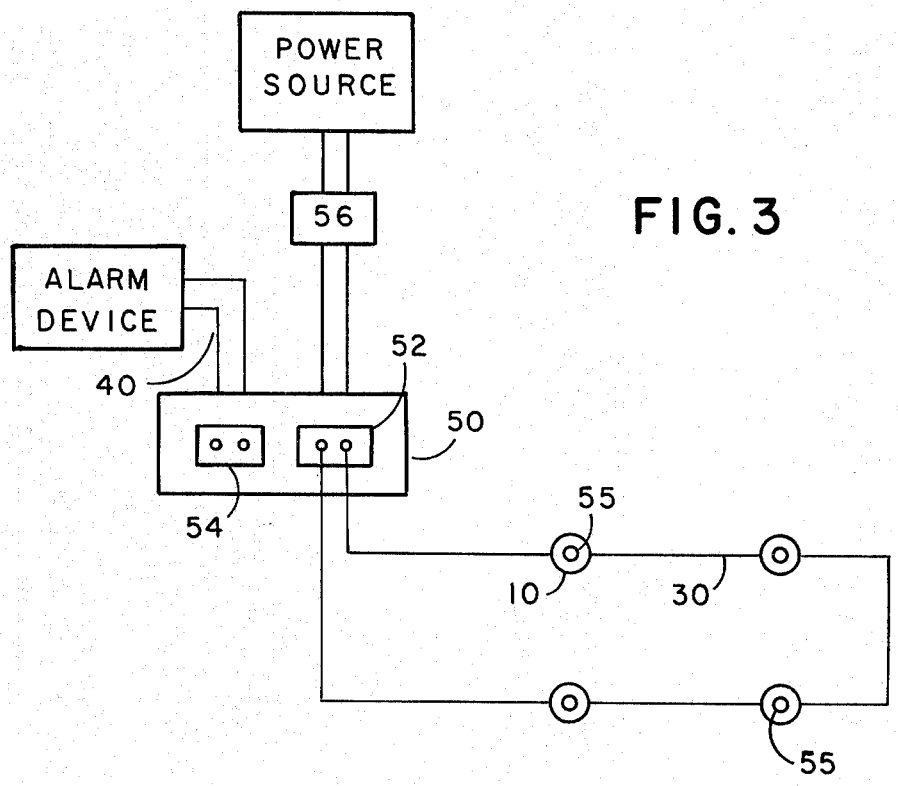
FIG. 3 illustrates schematically the supervisory and alarm circuitry for the detection device of FIGS. 1 and 2.

As illustrated schematically in FIG. 3, alarm circuit 40 connects with a relay 50. Relay 50 which is a double throw-double pole relay has one pole 52 connected to supervisory circuit 30, the other pole 54, connected to alarm circuit 40. Interruption of supervisory circuit 30, through the removal of extinguisher 55 breaking lanyard 11 or its socket-like receptacle connection, of detection device 10, will cause the supervisory circuit relay pole 52 within relay 50 to drop out. The interruption of this circuit activates relay pole 54, connected with alarm circuit 40, causing transmission of current to alarm circuit 40. An appropriate alarm device such as a bell, located in a remote area such as a main office, is thereby activated. The circuit of FIG. 3 requires only a 6 volt current which may be provided by batteries or, as illustrated, by a 120 volt power source reduced to 6 volts by a transformer 56.

Figure 4:
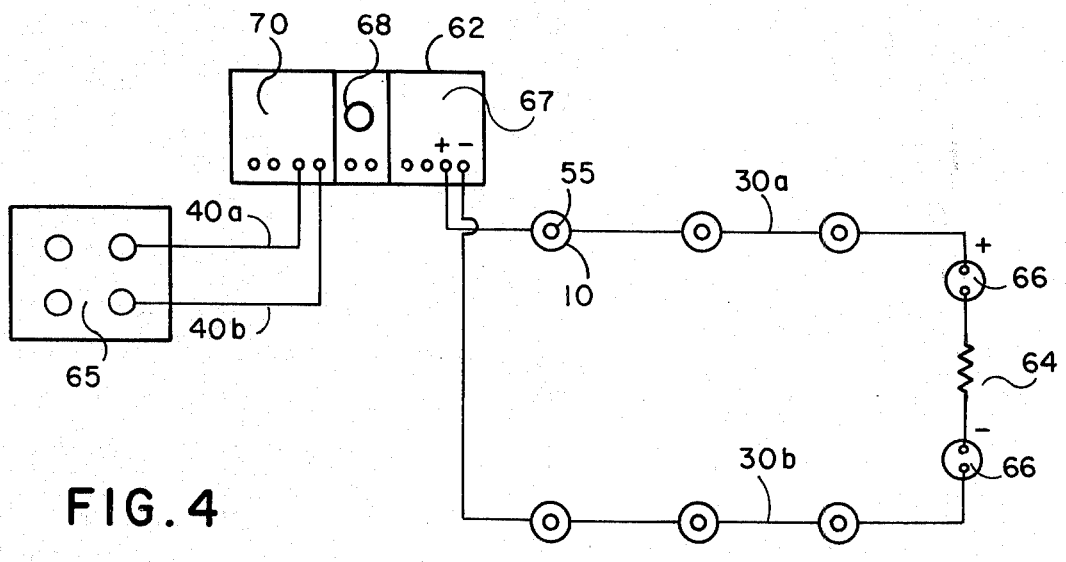
FIG. 4 illustrates schematically an alternative supervisory and alarm circuitry embodiment of a zoned detection system for the detection device of FIGS. 1 and 2.

FIG. 4 further illustrates schematically supervisory circuit lines **30*a*, 30*b*, corresponding detection circuit lines 40*a*, 40*b*, a plurality of fire extinguisher removal detection devices 10 of the present invention and control panel means 62 for zone detection, that is for various locations within a building for example. Each zone, two of which are illustrated, has distinct supervisory and detection circuits, supervisory circuits 30*a*, 30*b* being connected by an end-of-line resistor 64. An indicator alarm 65** corresponds to each circuit zone so an operator may easily distinguish the trouble area.

Six volt batteries 66 are positioned on either side of end-of-line resistor 64 in series to provide current for supervisory circuit lines 30*a*, 30*b* through sensitive relay 67 which can detect interruption of a particular circuit zone, that is by receipt of positive or negative voltage surge. Upon supervisory circuit 30*a* or 30*b* interruption, key switch 68 is activated to thereby activate latching relay 70. Latching relay 70 thereby connects the appropriate corresponding alarm circuit line 40*a*, 40*b*, the current for alarm circuit 40*a*, 40 *b* being provided at the control area. The appropriate corresponding zoned indicator alarm is thereby activated so an operator may easily distinguish the trouble area. Again a transformer may be used to reduce a 120 volt current to a 6 volt current to power said circuits.

The foregoing embodiments are merely illustrative of the principles of the present invention, the inventor wishing to not be strictly limited thereto as modifications may be made by one skilled in the art without departing from the spirit of the invention. In effect, the wire lanyard detection device means of the present invention could be used to encompass any object one wishes to monitor for potential removal. The inventor thereby wishes to be limited only by the spirit of the combination detection device and alarm system as determined by the scope of the following claims.

I claim:

1. A detection device and alarm system for the detection of the removal of a fire extinguisher from its usual location within a particular zone comprising in combination:

a plurality of break-away electrically conductive wire lanyard means interposed upon a supervisory circuit;

two male prong-female receptacle break-away connections to transfer supervisory current to said lanyard and a male prong-female receptacle connection to output supervisory current from said lanyard to said supervisory circuit and the next detection device in series;

said female receptacle being stationarily secured;

an end-of-line supervisory circuit resistor to define said zones;

two batteries, one on either side of said resistor, connected in series to provice current for said supervisory circuit;

a sensitive relay connected to monitor each zone of said supervisory zoned circuit current to detect interruption of said zoned circuit;

a control alarm means having indicators corresponding to each of said supervisory circuit zones to indicate interruption of said supervisory circuit in a particular zone;

alarm circuit lines to correspond with and differentiate each zone of said supervisory circuit, connected to said alarm indicator means;

a latching relay to activate a particular alarm circuit;

a power source to supply current to said alarm circuit through said latching relay upon interruption of a particular zone of said supervisory circuit; and switch means activated by said sensitive relay upon interruption of said supervisory circuit to in turn activate said latching relay to supply power to an alarm circuit line corresponding with the interrupted supervisory circuit zone.

2. The alarm system combination of claim 1 wherein said batteries of said supervisory circuit produce a current of 6 volts.

3. The alarm system combination of claim 1 wherein said alarm circuit power source includes a transformer to reduce 120 volts current to 6 volts.

4. A detection device and alarm system, having indicator alarm means and provided electrical current from a power source, for the detection of the removal of a fire extinguisher from its usual location comprising in combination:

a supervisory electrical circuit receiving current from said power source;

an alarm circuit, distinct from said supervisory circuit, having said indicator alarm means connected thereto and receiving current only to transfer an alarm condition;

a plurality of break-away electrically conductive wire lanyard devices connected in series interposed upon said supervisory circuit;

a plurality of two-pole circuit breaker means, one such circuit breaker means connecting each of said wire lanyards to said supervisory circuit such that current is transferred through said lanyards;

a double throw-double pole relay means interposed upon, transferring and conducting current to said supervisory circuit from said power source and connected to and capable of transferring current to said alarm circuit to activate said alarm means upon interruption of said supervisory circuit;

each of said wire lanyard means being connected to said supervisory circuit through a two male prong - female receptacle pole break-away circuit breaker means, one pole receiving said supervisory circuit to transfer power through said lanyard and one pole to receive power from said lanyard and output same;

a locking box to secure said two male prongs, each one to an end of said lanyard, providing a unified movement thereby;

a housing jack to contain said female receptacle, having bracket means to fixably secure said housing jack in a stationary position;

said double pole-double throw relay means having a first pole connected to and transferring current from said power source to said supervisory circuit and a second pole connected to said alarm circuit activated upon the interruption of said supervisory circuit whereby said first pole drops out, causing said second pole to transmit current from said power source to said alarm circuit.

5. The combination of claim 4 wherein said current is 6volts produced by batteries.

6. The combination of claim 4 further including a transformer to reduce a 120 volt power source current to a 6 volt current.

* * * * *